US010807775B2

(12) United States Patent
Andreasen

(10) Patent No.: US 10,807,775 B2
(45) Date of Patent: Oct. 20, 2020

(54) CONTAINER SEALING AND PRESSURIZING SYSTEM AND METHOD

(71) Applicant: Kai Andreasen, Portland, OR (US)

(72) Inventor: Kai Andreasen, Portland, OR (US)

(73) Assignee: Kai Andreasen, Portland, OR (US)

( * ) Notice: Subject to any disclaimer, the term of this patent is extended or adjusted under 35 U.S.C. 154(b) by 0 days.

(21) Appl. No.: 16/383,272

(22) Filed: Apr. 12, 2019

(65) Prior Publication Data

US 2019/0315537 A1 Oct. 17, 2019

Related U.S. Application Data

(60) Provisional application No. 62/656,523, filed on Apr. 12, 2018.

(51) Int. Cl.

| | |
|---|---|
| ***B65D 51/00*** | (2006.01) |
| ***B65D 53/02*** | (2006.01) |
| ***B65D 55/08*** | (2006.01) |
| ***B65D 47/06*** | (2006.01) |
| ***B65D 81/38*** | (2006.01) |
| ***B67D 1/00*** | (2006.01) |
| ***B67D 1/04*** | (2006.01) |
| ***B67D 1/08*** | (2006.01) |
| ***B01F 3/04*** | (2006.01) |

(52) U.S. Cl.

CPC ..... *B65D 51/007* (2013.01); *B01F 3/04801* (2013.01); *B65D 47/06* (2013.01); *B65D 53/02* (2013.01); *B65D 55/08* (2013.01); *B65D 81/3837* (2013.01); *B67D 1/0004* (2013.01); *B67D 1/0418* (2013.01); *B67D 1/0808* (2013.01); *B01F 2003/049* (2013.01); *B01F 2003/04921* (2013.01); *B01F 2215/0022* (2013.01)

(58) Field of Classification Search

CPC .. B65D 51/007; B65D 81/3837; B65D 47/06; B65D 55/08; B65D 53/02; B01F 3/04801; B01F 2003/04921; B67D 1/0808; B67D 1/0418; B67D 1/0004

USPC ..... 222/399; 220/315

See application file for complete search history.

(56) References Cited

U.S. PATENT DOCUMENTS

| | | | | |
|---|---|---|---|---|
| 5,501,357 | A * | 3/1996 | Fullin | B65D 51/007 220/258.2 |
| 9,027,775 | B2 * | 5/2015 | Brandt | B65D 45/345 215/274 |
| 9,926,117 | B2 * | 3/2018 | Lee | B65D 51/007 |
| 2015/0191293 | A1 * | 7/2015 | Forcella | B65D 81/3876 220/592.16 |
| 2017/0240405 | A1 * | 8/2017 | Gibson | B67D 1/0406 |
| 2019/0169014 | A1 * | 6/2019 | McIntyre | B67D 1/0412 |

* cited by examiner

*Primary Examiner* — Donnell A Long

(74) *Attorney, Agent, or Firm* — Holzer Patel Drennan

(57) ABSTRACT

Beverages such as beer and soda which contain carbon dioxide or other gases may degrade in quality when subjected to atmospheric pressure, oxygen, and/or light. It may be desirable to store such beverages in containers which prevent exposure to these conditions. An aluminum can is one such container but is associated with the problem of resealing the can after breaking the seal. The described utilities provide for resealing, pressurizing, and/or dispensing from an aluminum can or similar beverage container.

12 Claims, 7 Drawing Sheets

CONTAINER SEALING AND PRESSURIZING SYSTEM AND METHOD

RELATED APPLICATIONS

This application claims the benefit of U.S. Provisional Application 62/656,523, filed on Apr. 12, 2019, entitled "CONTAINER SEALING AND PRESSURIZING SYSTEM AND METHOD" the entirety of which is incorporated herein by reference.

FIELD OF THE INVENTION

The present disclosure relates generally to preserving and/or dispensing a beverage infused with carbon dioxide or another gas.

BACKGROUND

With craft brewing becoming more and more popular, many breweries create limited volume releases that customers value. Frequently, these limited release beers are not packaged in standard cans or bottles, which would provide for off-sale consumption, but are offered only in draft form on-site. Therefore, a customer wanting to leave the brewery or taproom with such a beer has limited options for transporting it because a critical element of a beer transport container is an effective seal to prevent oxidation, loss of carbonation, etc.

One option is a "growler," typically a 32-64 oz. glass container, that can be filled with beer or another beverage and sealed with a lid, for example, a threaded screw-on cap. Importantly, beverages such as beer may rely upon carbonation to convey certain flavors. For example, carbon dioxide ($CO_2$) carries the acids that provide the flavor from hops. Therefore, a reduction in carbonation causes a reduction of flavor, and perhaps even increased sweetness. Oxygen also may damage the hop flavor of beer through oxidation. In this regard, the essential oils and acids become bland and papery when exposed to oxygen. Growler lids do not create perfect seals and will allow oxygen ingress and $CO_2$ egress from the growler over a period of time. Therefore, in a growler, oxygen can quickly damage the essential oils and alpha/beta acids that make up the hop flavor, causing beer to diminish in quality. Similarly, light may also penetrate a glass growler and impact the flavor profile. Therefore, even under ideal circumstances, a growler may only keep a beer "fresh" for a little over a week.

As another option, "crowlers" refer to large cans that can be seamed/sealed on-site at a bar or brewery. Crowlers are designed as an alternative to a growler and solve several problems associated with growlers. In this regard, crowlers maintain an improved seal compared to growlers by using a seamed aluminum lid (e.g., with a scored opening that can be opened by exerting pressure from a tab similar to a standard soda can "pop top") that keeps oxygen out for months instead of merely days. Moreover, as the body of a crowler is typically constructed from aluminum, light is unable to penetrate the container, which can prevent "light strike" that may lead to degradation of the beer.

Given the benefits of crowlers, they are viewed by many as a superior option for storing and transporting draft beer. However, a typical crowler has a volume of 32 oz., which is about two pints. Although two pints may be a reasonable volume of a standard beer to consume in a single sitting upon breaking the seal on a crowler, many beers packaged into crowlers are rare, costly, and/or have a relatively high alcohol content. Therefore, many consumers prefer not to consume the entire 32 oz. in one sitting, but rather prefer to sample the beer in small volumes (e.g. 6-10 oz.) over several days. Unfortunately, the nature of crowlers prevents consumers from resealing the container once opened, thereby leading to diminished quality of beer or waste, potentially even faster than degradation of quality associated with growlers due to the fact that the quality of a beer subjected to atmospheric pressure, oxygen, and light may diminish rapidly. In fact, even those consumers intending to consume the entire contents of a crowler over an hour or two may desire to reseal and/or pressurize the crowler between pours.

SUMMARY

The present disclosure is directed to utilities (apparatus, system, and method) for resealing a crowler containing a beverage (e.g., beer, sparkling wine, soda, etc.). Some embodiments may further include functionality for repressurizing a crowler and/or dispensing a beverage from a crowler.

It should be appreciated that although the description provided herein specifically refers to crowlers and/or cans, the present disclosure is intended for use in relation to crowlers, cans, bottles, or any other beverage container compatible with the described embodiments and these terms are used interchangeably. Various sizes and shapes of the described apparatuses and systems are envisaged for use on corresponding containers. Additionally, descriptions herein are presented in the context of beer but one of ordinary skill in the art will appreciate that the utilities described herein are similarly applicable to any beverage containing one or more gases, such as carbon dioxide, nitrogen, or the like.

In an aspect of the present disclosure, an apparatus for sealing a beverage can is provided. The apparatus may include a lid, a gasket, and a locking mechanism. The lid may be sized for at least partial receipt within a recess disposed at an end portion of the beverage can. In this regard, many beverage cans include a raised lip around the top panel of the can formed by an outer rolled seam where the sidewall of the can is joined to the can lid (e.g., the portion which includes the opening) of the can. This raised lip may define the recess into which the lid may disposed. The end portion of the can may comprise an opening (e.g., scored "pop-top") between an interior volume of the beverage can and an exterior environment. The opening may be formed in the top panel. The gasket may be disposable within the recess to extend continuously about the opening. In some embodiments, the gasket may be circular and sized for receipt within a groove which is formed in many standard can tops, the groove being disposed just inside the outer seam between the top panel and a chuck wall of the lid. In other embodiments, the gasket may be any size or shape large enough to extend continuously around the opening. The locking mechanism of the apparatus may be configured to engage a portion of the lid and a portion of the beverage can to compress the gasket between the lid and the beverage can to seal the opening to isolate the interior volume from the exterior environment. In this regard, gases from inside the beverage can are contained within a volume defined by the bottom side of the lid of the apparatus and an interior wall of the gasket, extending into the interior of the can.

A number of feature refinements and additional features are applicable to the first aspect. These feature refinements and additional features may be used individually or in any combination. As such, each of the following features that will be discussed may be, but are not required to be, used with any other feature or combination of features of the first aspect.

For example, in some embodiments, the locking mechanism may be configured to engage an outer seam defining a perimeter of the end portion of the beverage can to apply a force to the lid. The force may have a vector component normal to the end portion of the beverage can to compress the gasket between the bottom side of the lid and the top side (exterior) of the top panel. As mentioned above, the gasket may be disposable within a groove disposed upon the end portion and extending about the opening.

In some embodiments, the locking mechanism may comprise a strap. The strap may have a generally C-shaped cross section and may be sized and shaped to extend about the perimeter of the end portion of a can and engage the seam. The strap may be annular and sized to extend about the end portion. The strap may be formed from any suitable materials including but not limited to metals (e.g., aluminum), fabrics (e.g., Kevlar), or plastics. The strap may be solid (e.g., a ring) or may be split. In the latter regard, the strap may be split such that it has two opposing ends which may be joined together during installation. In this regard, the split strap may be compressingly engaged to the beverage can. The strap may further comprise a fastening mechanism that fastens a first end of the strap to a second end of the strap to form a ring. The fastening mechanism may include a hinged lever disposed adjacent the first end, a hook operatively engaged with the hinged lever and configured to pivot therewith in relation to the first end, and a catch on the second end configured for receipt of the hook. In this regard the hook may be disposed over the catch by a user and the lever may be manipulated to engage the hook and catch, thereby reducing a diameter of the strap to tightly engage the lid and beverage can.

In further embodiments, the locking mechanism may comprise a plurality of latches disposed around a perimeter of the lid. Each latch of the plurality of latches may comprise a hinged clip configured to engage the seam. The clips may include a hook which is sized and shaped for receipt within an exterior portion of the outer seam of the can top. However, other contemplated embodiments for securing the apparatus to a beverage container are contemplated, which may include a threaded interface or other appropriate interface.

Some embodiments may further comprise a pressurization port. The pressurization port may be in fluid communication with the interior volume of a beverage can. The pressurization port may be engageable with a gas source to inject a gas into the interior volume of the beverage can. The pressurization port may comprise an orifice passing from a first side of the lid to a second side of the lid opposite the first side. A first portion of the orifice adjacent a first end of the orifice on the first side of the lid may be defined by a threaded wall configured for receipt of corresponding threads of the gas source. A second end of the orifice on the second side of the lid may be in fluid communication with the interior volume to supply gas from the gas source through the opening. The gas source may comprise, for example, a pre-filled, pressurized gas cartridge.

In additional embodiments, a valve may be disposed between the first end and the second end of the orifice. A valve handle configured for manual manipulation of the valve may also be provided such that the valve is operable to selectively establish the fluid communication between the gas source and the interior volume of the beverage can. In this regard, the gas source may contain a gas at a higher pressure than the interior volume of an opened beverage can, which is generally ambient air pressure. When the valve is opened, the high pressure gas may pass through the orifice and into the interior volume of the beverage can, thereby increasing the internal pressure. This may also introduce the gas into the head space of the can. As discussed below, this may be beneficial for preserving the beverage in the can.

Furthermore, embodiments may include, but need not necessarily include, a beverage dispenser in fluid communication with the interior volume of the beverage can. Such a beverage dispenser may comprise a nozzle, a tube, a second valve, and a second valve handle. The nozzle may be disposed on the first side (e.g., top) of the lid. The tube may extend from the lid (e.g., bottom side) and may be in fluid communication with the nozzle. The tube may be configured for insertion of an end of the tube opposite the lid into the interior volume of the beverage can. The second valve may be disposed within the nozzle and the second valve handle may be configured for manual manipulation of the second valve. The second valve may be operable to selectively establish fluid communication between the interior volume of the can and a dispensing port in the nozzle. A flow of beverage from the interior volume through the dispensing port may be drivable by a gas pressure in the interior volume of the beverage can which exceeds an ambient air pressure outside the beverage can.

It is envisaged that the gas may comprise any suitable gas such as carbon dioxide or nitrogen. The gas from the gas source may be the same as a gas dissolved in the beverage or may be another gas, for example, a gas lacking oxygen to prevent oxidation. The apparatus may further comprise a purge valve configured to vent high pressure gas from the interior volume of the can upon rapid injection of the gas from the gas source to purge ambient air from the interior volume of the can and replace the ambient air with the gas (e.g., from the pressurized gas source).

In a second aspect, the present disclosure includes an apparatus for sealing a beverage can comprising a housing, a lid, and a locking mechanism. The housing may define a chamber configured for receipt of a beverage can. The lid may be configured for engagement with the housing to enclose a volume of space within the chamber. The lid may or may not rest on a top surface of a beverage can when engaged with the housing. In this regard, the bottom of a can may rest on a bottom portion of the housing with a gap between the top of the can and the lid. Alternatively, the lid may rest against the top of the can and utilize a gasket to form a seal. At least an end portion of the beverage can may be disposable within the volume of space, the end portion of the beverage can comprising an opening between an interior volume of the beverage can and an exterior environment. In this regard, a seal may be formed at any portion of the exterior of the beverage can, for example, using a gasket around an exterior of a sidewall of a can. The locking mechanism may be configured to retain the lid in sealed engagement with the housing.

A number of feature refinements and additional features are applicable to the second aspect. These feature refinements and additional features may be used individually or in any combination. As such, each of the following features that will be discussed may be, but are not required to be, used with any other feature or combination of features of the first aspect. For example, a pressurization port, valve, or beverage dispenser as described above may be included.

In an embodiment, the housing may comprise at least one thermally insulating layer. The thermally insulating layer may have a size and shape corresponding to a standard beverage can such that the thermally insulating layer is adjacent to or contacts a majority of the exterior surface area of the can. The thermally insulating layer may comprise any suitable material such as a foam, like polystyrene, or a double-wall containing a vacuum. Alternatively or additionally, a gap may be disposed between the thermally insulating layer and the exterior of the beverage can. This may allow for gas from the gas source to surround the can. As the gas expands as it leaves the high pressure gas source, it may cool, thereby providing for a lower temperature inside the housing compared to ambient air. The thermally insulating layer may aid in retaining the lower temperature over a period of time.

The housing may further comprise a second chamber configured for receipt of a second beverage can. In this regard, a single housing may be used with duplicate lids, nozzles, tubes, insulation, etc. This may be desirable, for example, to provide a means for sealing, pressurizing, and/or dispensing a variety of beverages with a single apparatus.

A biasing mechanism may be configured to bias the beverage can toward the lid when the lid is in sealed engagement with the housing. The biasing mechanism may comprise a spring disposed in a portion of the chamber configured for receipt of a bottom end of the beverage can opposite the end portion of the beverage can comprising the opening. The spring may be compressed as a beverage can is inserted such that the lid restricts the top of the beverage can in a manner which prevents the spring from elongating. This may be desirable in embodiments utilizing a gasket between the top of the can and the bottom side of the lid to form a seal. A plate, e.g., a circular plate, may be provided in conjunction with the spring to distribute the force from the spring over a broader area of the bottom of the can.

It should be appreciated that the described utilities may be used not only to maintain carbonation of a beverage, but may be used to carbonate a beverage that is initially not carbonated. In this regard, a flat beverage (e.g., one without carbonation) may be subjected to high pressure $CO_2$ from a gas source which causes dissolution of the $CO_2$ into the beverage. It should be appreciated that any suitable gas (e.g., nitrogen) may be used in this manner, not just $CO_2$. This may be useful when a beverage has gone flat due extended storage (e.g., slow leaking of gas from a sealed can over weeks or months) or after the can has been opened, or may also be used for the initial carbonation of a beverage (e.g., making soda from flat water).

DETAILED DESCRIPTION

Figure 1:
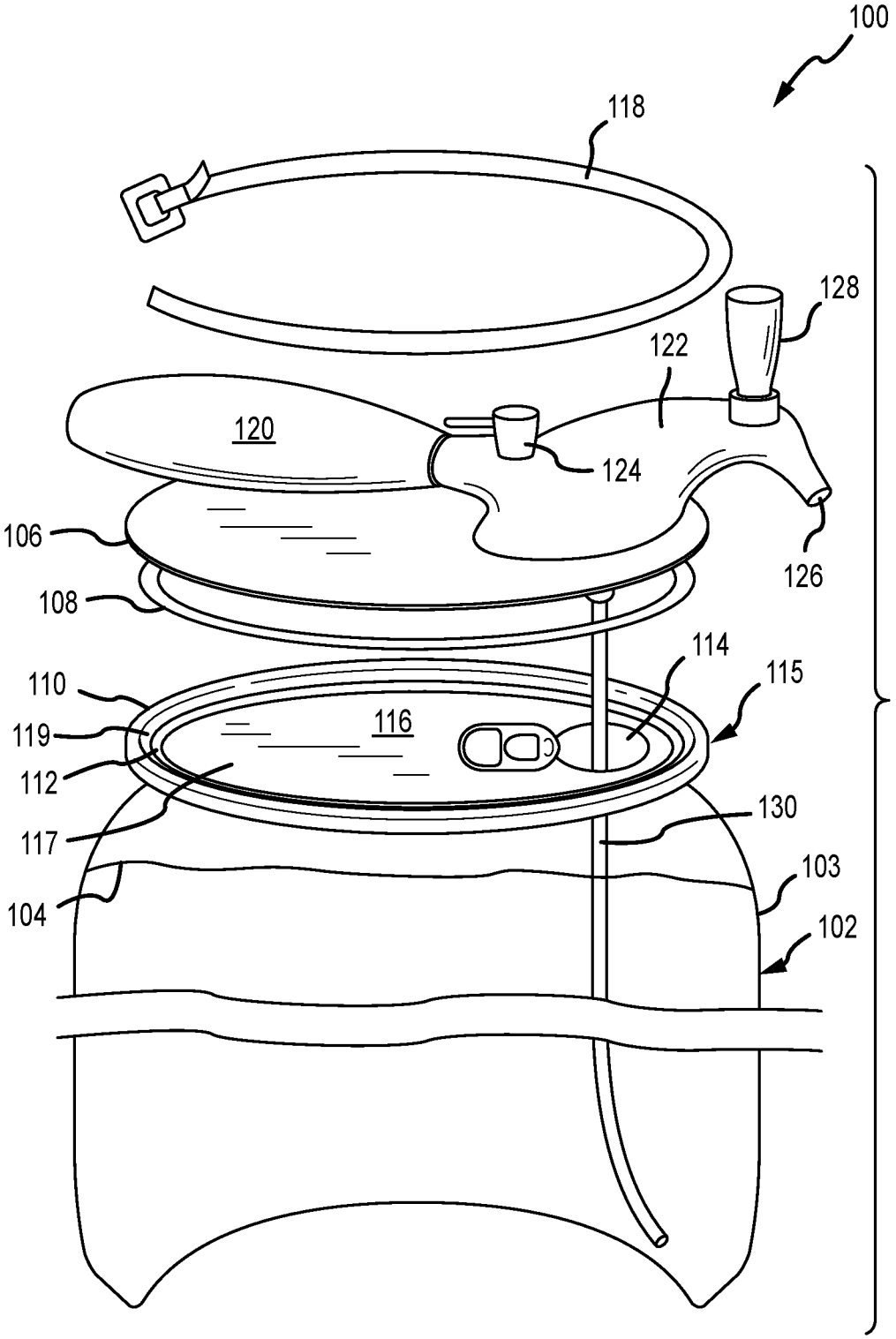
FIG. 1 illustrates an embodiment of an apparatus for sealing an opened beverage container.

While the invention is susceptible to various modifications and alternative forms, specific embodiments thereof have been shown by way of example in the drawings and are herein described in detail. It should be understood, however, that it is not intended to limit the invention to the particular form disclosed, but rather, the invention is to cover all modifications, equivalents, and alternatives falling within the scope of the invention as defined by the claims.

With regard to FIG. 1, an apparatus 100 for sealing an opened beverage container is shown. In the illustration, the beverage container is a beverage can 102, however, it is envisaged that any compatible beverage container may be used. A lid 106 may be sized and shaped for receipt within a recessed portion of beverage can 102. For example, recess 116 may be defined by a raised lip formed by a rolled seam 110 between the can lid 115 and sidewall 103 of beverage can 102. A gasket 108 may be provided to ensure an airtight seal to prevent gas from escaping the beverage 104 and ultimately, the beverage can 102. The gasket 108 may be sized for receipt within a groove 112 formed in the beverage can 102 between a top panel 117 and a chuck wall 119. Such a groove 112 is typical on many standard cans and extends around the opening 114 adjacent to the chuck wall 119. A means for securing the lid 106 to the beverage can 102 is contemplated. In the illustrated embodiment, the means provided is a strap 118 configured to encircle the lid 106 and rolled seam 110 to apply a force normal to the top of the beverage can 102 to squeeze the gasket 108 between the bottom side of the lid 106 and the top of the beverage can 102.

The above description of the apparatus 100 of FIG. 1 is contemplated as being a standalone device in some embodiments. In other embodiments, additional features may be included. In one such embodiment, a gas source is provided to pressurize the inside volume of the beverage can 102 after a seal is formed (e.g., securing the lid 106 to the beverage can 102 in a manner which sandwiches the gasket 108). In the illustrated embodiment, the gas source is a pressurized cartridge 120. It is contemplated that any suitable gas source may be used, for example, a hose connected to a remote tank or compressor. The pressurized cartridge 120 may contain $CO_2$, nitrogen, or any other suitable gas. The pressurized cartridge 120 or other gas source may be threaded for mating engagement with corresponding threads on a pressurization port (not shown) comprising an orifice extending from the gas source on the top side of the lid 106 through the bottom side of the lid 106 and into the interior volume of the beverage can 102. A valve handle 124 may be provided to control the flow of gas from the gas source into the interior volume.

Figure 8:
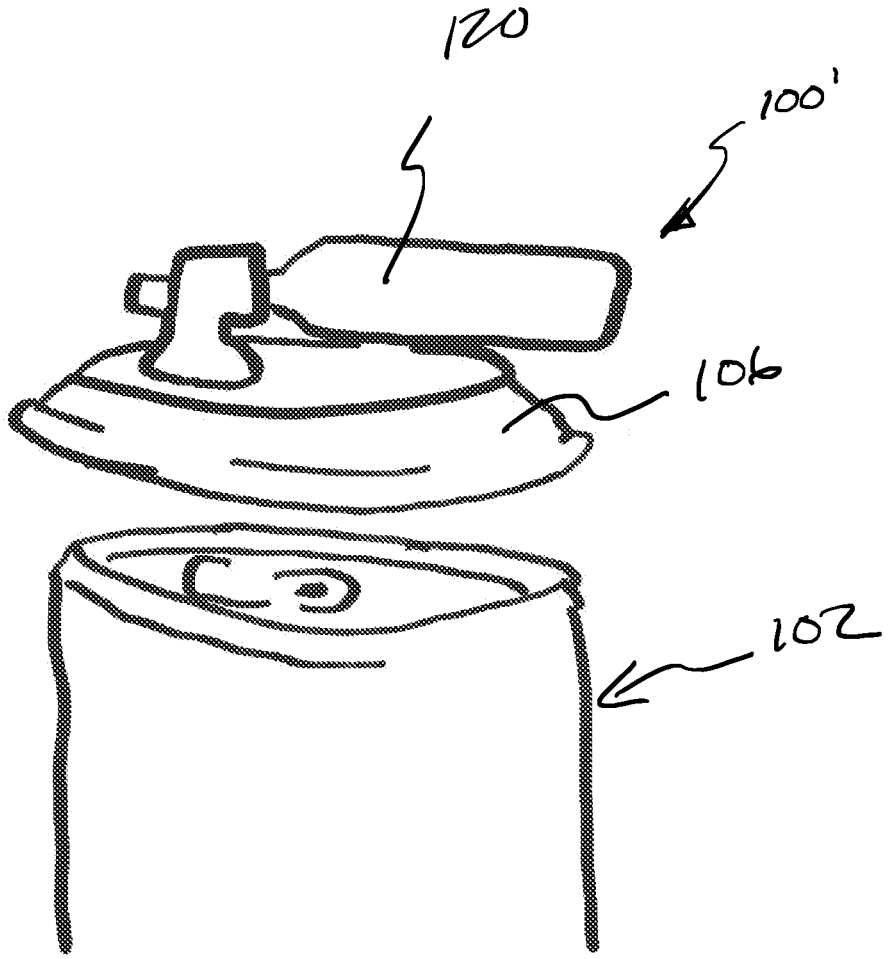
FIG. 8 illustrates an embodiment of an apparatus for sealing an opened beverage container that includes for pressurization of the container with a gas.

Additionally, an apparatus 100 may comprise a dispensing mechanism, such as nozzle 122. In the illustrated embodiment, the point of attachment for the pressurized cartridge 120 is integrally formed with nozzle 122, however, it should be appreciated that these two features may be standalone components. For instance, in FIG. 8, an alternate embodiment to that depicted in FIG. 1 is shown in which an apparatus 100' includes a pressurized cartridge 120, but no dispensing mechanism. In this regard, the embodiment of the apparatus 100' shown in FIG. 8 may have all features common to the apparatus 100 shown in FIG. 1 with the exception of the dispensing mechanism. With returned reference to FIG. 1, valve handle 128 may be operable to control a flow of beverage 104 from the interior volume of the beverage can 102 through tube 130, into nozzle 122, and out dispensing port 126.

Opening the valve controlled by valve handle 124 may release high pressure gas (e.g., $CO_2$, nitrogen, etc.) from the gas source (e.g., pressurized cartridge 120) and into the interior volume of the can. Notably a volume of space between the top panel 117 of the can and the bottom of lid 106 may also be pressurized. The gas may maintain an elevated pressure inside the beverage can 102 relative to ambient air outside the beverage can 102. Operation of the valve controlled by valve handle 128 may cause the high pressure to force a flow of beverage 104 through tube 130 and out dispensing port 126.

Figure 2:
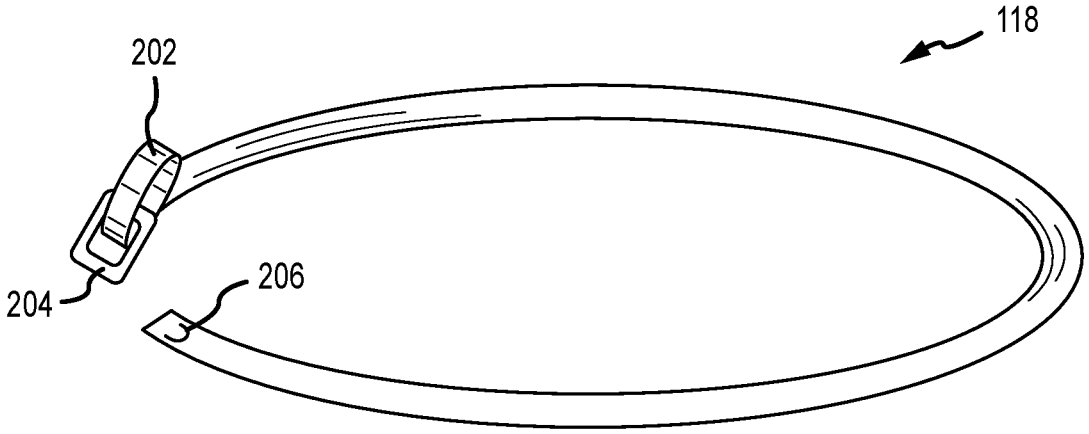
FIG. 2 illustrates an embodiment of a strap used in conjunction with the apparatus of FIG. 1.

FIG. 2 illustrates strap 118 as shown in FIG. 1. Strap 118 may be made from any suitable material including, inter alia, rubbers, plastics, metals, and fabrics. Strap 118 may be split (e.g., not a continuous loop) to allow expansion of the diameter for positioning over an end portion of the can. Lever 202 may be hingedly affixed to strap 118 for reciprocating movement and leverage of hook 204. A user may dispose hook 204 over catch 206, disposed near an opposite end of strap 118, when lever 202 is in an extended position. By manipulating lever 202 into a retracted position (e.g., tangent to strap 118) the user may reduce the diameter of strap 118 thereby tightening it around the lid.

Figure 3:
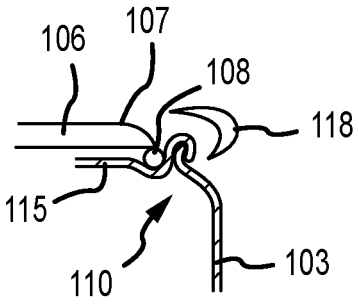
FIG. 3 provides a cross-section of the strap of FIG. 2.

FIG. 3 illustrates a cross-sectional view of strap 118 in relation to a beverage can and lid. Strap 118 may have a substantially C-shaped cross-section to engage the top side of the lid 106, and/or a beveled edge 107 of lid 106, and the bottom side of rolled seam 110. Rolled seam 110 may form a raised lip around the outer perimeter of the end portion of a can 102. The rolled seam 110 may be formed by rolling the outer edge of a can lid 115 with the flange of a can sidewall 103, as is common is standard aluminum cans. Tightening of strap 118 may exert a downward force (normal to top panel 117) on lid 106 causing gasket 108 to be compressed, forming a seal. Notably, gasket 108 is preferable but may be optional in some embodiments.

Figure 4:
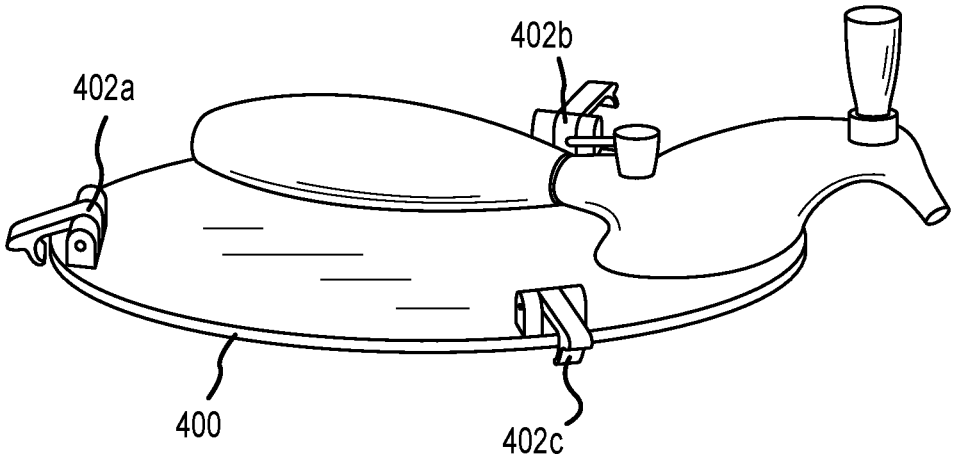
FIG. 4 illustrates an embodiment of a lid for use in sealing an opened beverage container.
Figure 5:
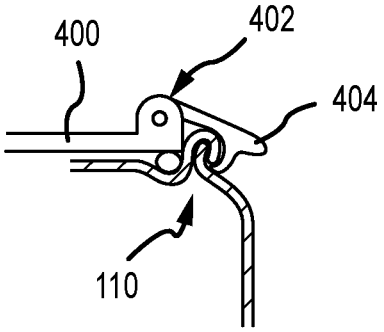
FIG. 5 provides a cross-section of the lid of FIG. 4.

FIG. 4 illustrates a lid 400 which has an alternate mechanism for securing the lid 400 to a beverage can which is an alternative to strap 118. Lid 400 may include a plurality of latches 402*a-c*. As shown in the cross-section of FIG. 5, each latch 402 may comprise a hinged clip 404 with a length corresponding to a standard dimension of a beverage can to allow the tip of each clip 404 to snap onto a rolled seam 110. In the embodiment illustrated in FIG. 5, lid 400 is sized for receipt within the recess 116 formed on the end portion of the beverage can 102. However, it should be appreciated that in some embodiments, the lid 106 may have a larger diameter allowing it to rest on top of the raised lip formed by the rolled seam 110.

Figure 9:
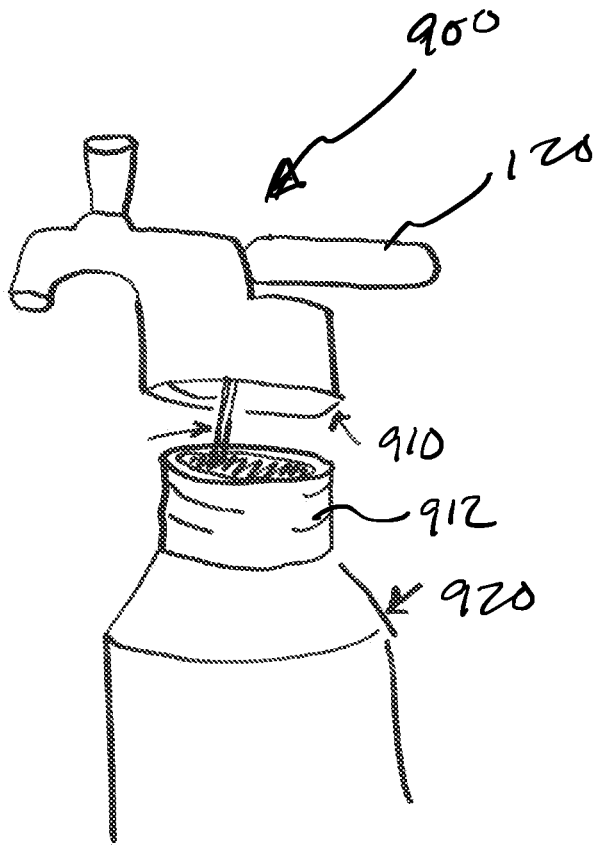
FIG. 9 illustrates an embodiment of an apparatus for sealing and pressurizing an opened beverage container that includes a dispensing port, in which the apparatus is secured to the opened beverage container using a threaded interface.
Figure 10:
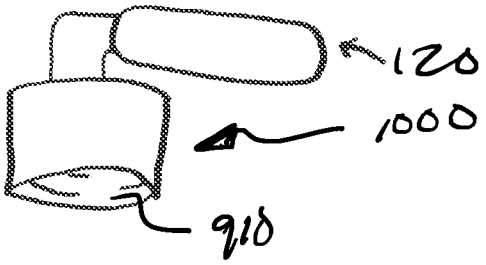
FIG. 10 illustrates an embodiment of an apparatus for sealing and pressurizing an opened beverage container that includes a dispensing port, in which the apparatus is secured to the opened beverage container using a threaded interface.

FIG. 9 illustrates another embodiment of an apparatus 900 that may be used to seal and pressurize a beverage container 900. In the embodiment depicted in FIG. 9, the container 900 may include a threaded interface 912 near or about an opening of the container 900. In turn, the apparatus 900 may be secured in sealing engagement with the container 900 by way of a corresponding threaded portion 910 of the apparatus 900. As shown in FIG. 9, such an embodiment may include a dispensing mechanism as described above in relation to the embodiment of FIG. 1. FIG. 10 shows a further embodiment in which an apparatus 1000 includes a threaded portion 910 for sealing engagement with a container, but which does not include a dispensing mechanism. In this regard, the embodiment of the apparatus 1000 may allow for sealing and pressurization of a container through a threaded interface without dispensing capability.

Figure 6:
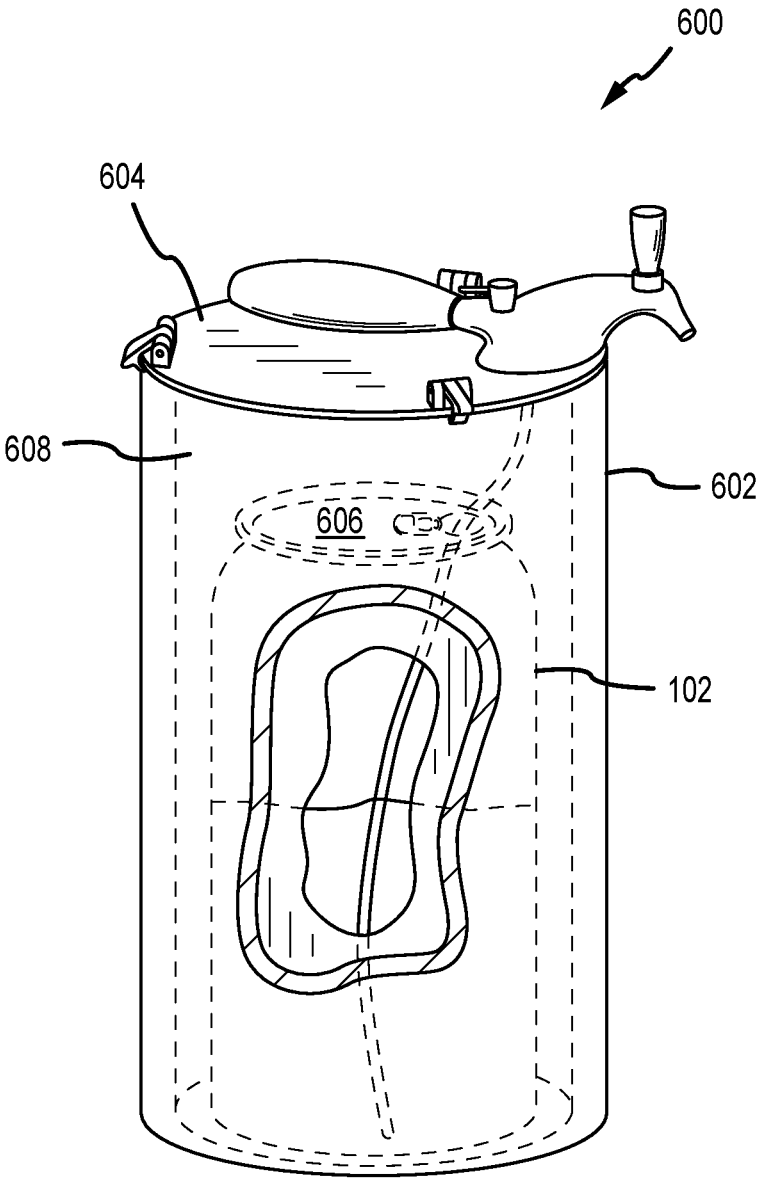
FIG. 6 illustrates an embodiment of an apparatus for sealing an opened beverage container.

FIG. 6 illustrates an embodiment of an apparatus 600 for sealing, pressurizing, and/or dispensing from a beverage container 102. In this embodiment, lid 604 may have features similar to those of either lid 106 of FIG. 1 and/or lid 400 of FIG. 4 (e.g., gas source, nozzle, etc.). However, lid 604 is configured for engagement with housing 602 rather than direct engagement of a beverage container 102. Housing 602 may define a chamber 608. Chamber 608 may correspond in size and shape to a beverage container 102, such as a can, for receipt of the beverage container 102 within chamber 608. As illustrated, a top end 606 of the beverage container 102 may be disposed within chamber 608 such that a gap exists between the top end 606 of the beverage container 102 and the bottom side of lid 604. Alternatively, chamber 608 may be sized such that the top end 606 rests against the bottom side of lid 604. A gasket (not shown) may optionally be disposed between lid 604 and housing 602 or between lid 604 and the top end 606 of beverage container 102. Any suitable means may be used to secure lid 604 to housing 602 such as a strap, latches, threads, snap-fitting, etc. The walls of housing 602 may be formed from a thermally insulating material to maintain the temperature of the beverage.

Figure 7:
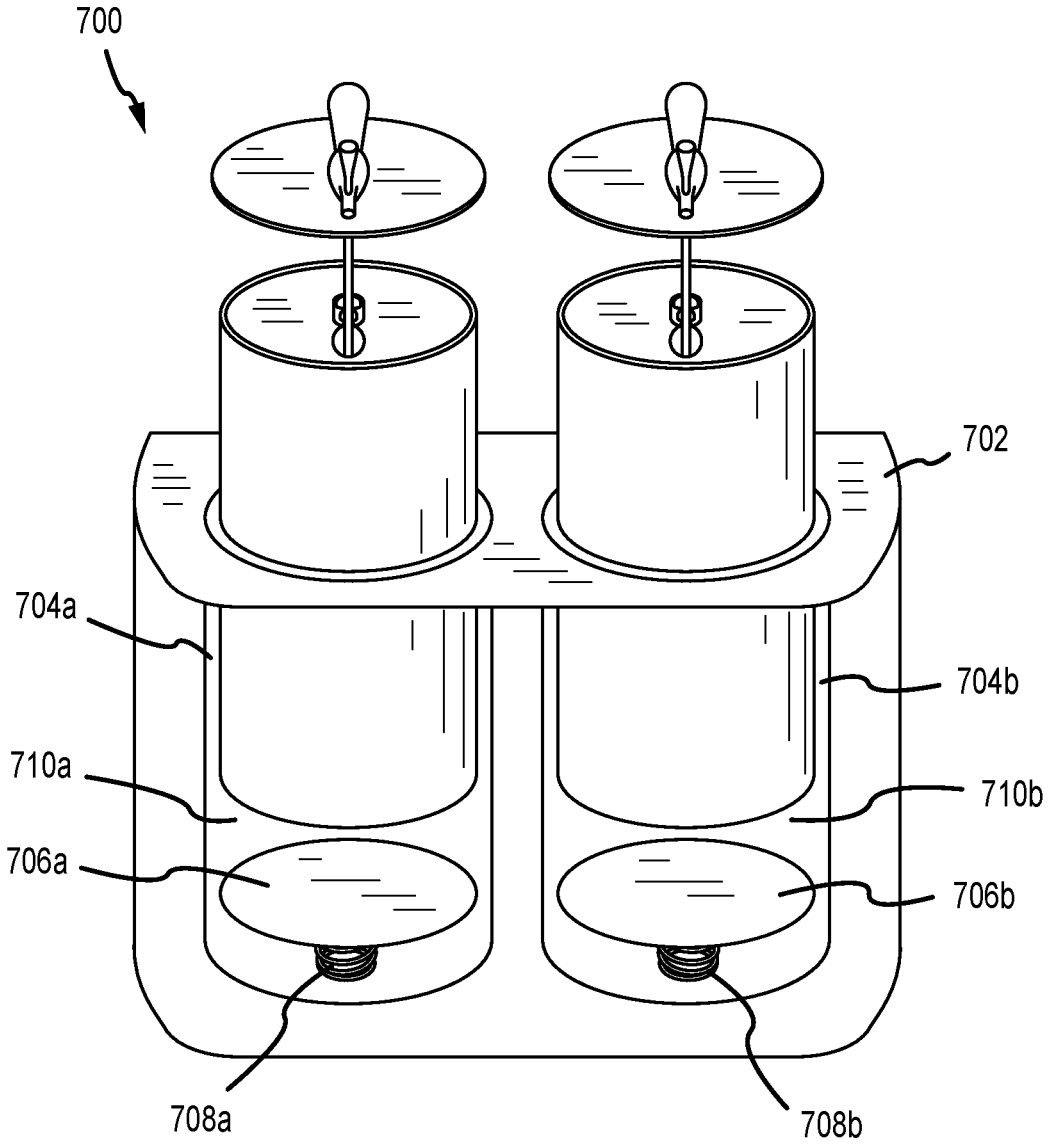
FIG. 7 illustrates an embodiment of an apparatus for sealing a plurality of opened beverage containers.

FIG. 7 illustrates an apparatus 700 for sealing, pressurizing, and/or dispensing from a plurality of beverage containers. Within housing 702 may be disposed a plurality of chambers 710*a-b* defined by thermally insulating walls 704*a-b*. Each chamber 710*a-b* may be enclosed using a lid which compresses a beverage container against a plate 706*a-b* biased by a spring 708*a-b*. In this regard, a beverage container may be sandwiched between the lid and plate 706*a-b* to aid in creating a seal. Moreover, such a design may also allow for use with beverage containers having a variety of heights.

While the invention has been illustrated and described in detail in the drawings and foregoing description, such illustration and description is to be considered as exemplary and not restrictive in character. For example, certain embodiments described hereinabove may be combinable with other described embodiments and/or arranged in other ways (e.g., process elements may be performed in other sequences). Accordingly, it should be understood that only the preferred embodiment and variants thereof have been shown and described and that all changes and modifications that come within the spirit of the invention are desired to be protected.

What is claimed is:

1. An apparatus for sealing a beverage can, comprising:

a lid sized for at least partial receipt within a recess disposed at an end portion of the beverage can, wherein the end portion comprises an opening between an interior volume of the beverage can and an exterior environment;

a gasket disposable within the recess to extend continuously about the opening, the gasket defining an enclosed volume between the end portion of the beverage can and a bottom portion of the lid that extends continuously relative to a portion of the end portion circumscribed by the recess;

a locking mechanism configured to engage a portion of the lid and a portion of the beverage can to compress the gasket between the lid and the beverage can to seal the opening to isolate the interior volume from the exterior environment; and a pressurization port in fluid communication with the enclosed volume and the interior volume of the beverage can, the pressurization port is engageable with a gas source to inject a gas into the enclosed volume and the interior volume of the beverage can.

2. The apparatus of claim 1, wherein the locking mechanism is configured to engage a seam defining a perimeter of the end portion of the beverage can to apply a force to the lid, the force having a vector component normal to the end portion of the beverage can to compress the gasket.

3. The apparatus of claim 2, wherein the gasket is disposable within a groove disposed upon the end portion and extending about the opening.

4. The apparatus of claim 3, wherein the locking mechanism comprises a strap, the strap having a generally C-shaped cross section, wherein the strap is sized and shaped to extend about the perimeter of the end portion and engage the seam.

5. The apparatus of claim 4, wherein the strap comprises a fastening mechanism that fastens a first end of the strap to a second end of the strap, the fastening mechanism comprising:

a hinged lever disposed adjacent the first end;

a hook operatively engaged with the hinged lever and configured to pivot therewith in relation to the first end; and a catch on the second end configured for receipt of the hook.

6. The apparatus of claim 3, wherein the locking mechanism comprises a plurality of latches disposed around a perimeter of the lid, each latch of the plurality of latches comprising a hinged clip configured to engage the seam.

7. The apparatus of claim 1, wherein the locking mechanism comprises a threaded portion engageable with corresponding threads on a beverage can.

8. The apparatus of claim 7, further comprising a purge valve, the purge valve configured to vent high pressure gas from the interior volume of the can upon rapid injection of the gas from the gas source to purge ambient air from the interior volume of the can and replace the ambient air with the gas.

9. The apparatus of claim 1, wherein the pressurization port comprises an orifice passing from a first side of the lid to a second side of the lid opposite the first side, wherein a first portion of the orifice adjacent a first end of the orifice on the first side of the lid is defined by a threaded wall configured for receipt of corresponding threads of the gas source, and wherein a second end of the orifice on the second side of the lid is in fluid communication with the interior volume to supply gas from the gas source through the opening.

10. The apparatus claim 9, further comprising:

a valve disposed between the first end and the second end of the orifice; and a valve handle configured for manual manipulation of the valve;

wherein the valve is operable to selectively establish the fluid communication between the gas source and the interior volume of the beverage can.

11. The apparatus of claim 1, further comprising a beverage dispenser in fluid communication with the interior volume of the beverage can.

12. The apparatus of claim of claim 11, wherein the beverage dispenser comprises:

a nozzle disposed on the first side of the lid;

a tube extending from the lid and in fluid communication with the nozzle, wherein the tube is configured for insertion of an end of the tube opposite the lid into the interior volume of the beverage can;

a second valve disposed within the nozzle; and a second valve handle configured for manual manipulation of the second valve;

wherein the second valve is operable to selectively establish fluid communication between the interior volume of the can and a dispensing port in the nozzle, wherein a flow of beverage from the interior volume through the dispensing port is drivable by a gas pressure in the interior volume of the beverage can which exceeds an ambient air pressure outside the beverage can.

* * * * *